US009907342B2

(12) United States Patent
Fisher

(10) Patent No.: US 9,907,342 B2
(45) Date of Patent: Mar. 6, 2018

(54) UNDERGARMENT WITH SUPPORT STRUCTURE

(71) Applicant: Zachary Fisher, Baltimore, MD (US)

(72) Inventor: Zachary Fisher, Baltimore, MD (US)

( * ) Notice: Subject to any disclaimer, the term of this patent is extended or adjusted under 35 U.S.C. 154(b) by 72 days.

(21) Appl. No.: 14/960,711

(22) Filed: Dec. 7, 2015

(65) Prior Publication Data

US 2016/0157531 A1 Jun. 9, 2016

Related U.S. Application Data

(60) Provisional application No. 62/088,969, filed on Dec. 8, 2014.

(51) Int. Cl.
*A41F 9/00* (2006.01)
*A41D 1/08* (2018.01)
(Continued)

(52) U.S. Cl.
CPC ..... *A41D 1/088* (2013.01); *A41B 9/02* (2013.01); *A41D 27/20* (2013.01); *A63B 71/1216* (2013.01)

(58) Field of Classification Search
CPC ..... A41B 9/02; A41B 9/04; A63B 71/1216; A41D 1/08
(Continued)

(56) References Cited

U.S. PATENT DOCUMENTS 2,055,973 A * 9/1936 Goss ..... A41B 9/12 128/891
2,058,970 A 10/1936 Flesh
(Continued)

FOREIGN PATENT DOCUMENTS

CA 2747893 1/2013
WO 98/39981 9/1998
(Continued)

OTHER PUBLICATIONS

Jockstraps. Bauer Elite Lockjock Sr. Compression Jock Short. Retrieved on Oct. 31, 2014 from: http://jockstraps888w.appspot.com/bauer-elite-lockjock-sr-compression-jock-short.html.
(Continued)

*Primary Examiner* — Tejash Patel
(74) *Attorney, Agent, or Firm* — Whiteford, Taylor & Preston, LLP; Gregory M. Stone

(57) ABSTRACT

An undergarment is provided having a support system configured to comfortably support a male wearer's genitalia throughout aggressive athletic movements. Inside of the undergarment, an internal pocket is formed by a generally H-shaped insert that holds the male wearer's genitalia in a forward position and keeps the wearer's genitalia aligned with the internal portion of the athletic cup positioned at the front of the undergarment. Additionally, the H-shaped insert positions the male wearer's genitalia away from their legs, providing increased support and comfort for the wearer. A cross-wall defining the back of the internal pocket holds the wearer's genitalia to prevent it from dropping backward or downward, and presses against the wearer's perineum at its top edge to further aid in creation of a barrier that even further reduces the risk of chaffing. The side panels of the H-shaped insert are so positioned with respect to the wearer's anatomy so as to pull the back portion of the undergarment forward against the wearer's buttocks, and the bottom portion of the undergarment upward against the bottom of the wearer's torso (and particularly against the wearer's perineum), when worn.

20 Claims, 4 Drawing Sheets

(51) Int. Cl.

| | |
|---|---|
| ***A41D 27/20*** | (2006.01) |
| ***A41B 9/02*** | (2006.01) |
| *A63B 71/12* | (2006.01) |

(58) Field of Classification Search
USPC ..... 2/403, 401, 466, 228, 238; 602/72
See application file for complete search history.

(56) References Cited

U.S. PATENT DOCUMENTS

| | | | | | |
|---|---|---|---|---|---|
| 2,438,310 | A | | 3/1948 | Ashe et al. | |
| 3,207,155 | A | * | 9/1965 | Cullen | A41B 9/02 2/403 |
| 3,220,410 | A | * | 11/1965 | Sloan | A41B 9/02 2/405 |
| 3,654,634 | A | | 4/1972 | Torres | |
| 4,106,514 | A | | 8/1978 | Lowth | |
| 4,261,060 | A | | 4/1981 | Zawacki | |
| 4,870,958 | A | * | 10/1989 | Webster | A61F 5/40 128/891 |
| 4,961,233 | A | * | 10/1990 | Black | A41D 1/084 2/228 |
| 4,967,768 | A | | 11/1990 | Tatro | |
| 5,070,869 | A | | 12/1991 | Zhang | |
| 5,210,882 | A | | 5/1993 | Moretz et al. | |
| 5,271,101 | A | * | 12/1993 | Speth | A41D 1/084 2/214 |
| 5,978,970 | A | * | 11/1999 | Bright | A41D 1/084 2/227 |
| 6,023,789 | A | | 2/2000 | Wilson et al. | |
| 6,041,441 | A | | 3/2000 | Counts et al. | |
| 6,245,036 | B1 | | 6/2001 | McRoberts et al. | |
| 6,289,520 | B1 | | 9/2001 | Page | |
| 6,662,378 | B2 | | 12/2003 | Vartanyan | |
| 7,178,176 | B1 | | 2/2007 | S-Cronenbold | |
| 7,631,369 | B2 | | 12/2009 | Geiwald et al. | |
| 7,676,853 | B1 | | 3/2010 | Cutlip | |
| 7,774,865 | B2 | | 8/2010 | Miller | |
| 7,958,571 | B2 | | 6/2011 | Kitsch et al. | |
| 8,087,097 | B2 | * | 1/2012 | Maier | A41D 1/084 2/227 |
| 8,332,968 | B1 | | 12/2012 | Williams | |
| 8,601,616 | B2 | | 12/2013 | Radford et al. | |
| 2004/0049835 | A1 | | 3/2004 | Horikoshi et al. | |
| 2005/0066408 | A1 | | 3/2005 | Varela | |
| 2005/0142986 | A1 | | 6/2005 | Belpaume | |
| 2005/0204458 | A1 | | 9/2005 | Wong | |
| 2006/0005301 | A1 | | 1/2006 | Taylor | |
| 2007/0180601 | A1 | | 8/2007 | Chou | |
| 2012/0167279 | A1 | | 7/2012 | Bigney | |
| 2012/0204325 | A1 | | 8/2012 | Todd | |
| 2012/0260400 | A1 | | 10/2012 | Franz | |
| 2013/0042394 | A1 | | 2/2013 | Wexler | |
| 2014/0047620 | A1 | | 2/2014 | Ingalls et al. | |
| 2014/0058312 | A1 | | 2/2014 | Ziehler et al. | |
| 2014/0276325 | A1 | | 9/2014 | Turkbas | |

FOREIGN PATENT DOCUMENTS

| | | |
|---|---|---|
| WO | 2010/128947 | 11/2010 |
| WO | 2014/044831 | 3/2014 |

OTHER PUBLICATIONS

Calvin Klein Underwear Athletic Trunk. Retrieved on Oct. 31, 2014 from: http://www.zappos.com/calvin-klein-underwear-athletic-trunk-black?ef_id=U6vRwwAABXAqqSpf:20141031194928:s.

Elite Hockey Senior Compression Jock Short with Pro-Fit Cup Retrieved on Oct. 31, 2014 from: http://www.dickssportinggoods.com/product/index.jsp?productId=42932256&cp=4406646.4413986.4413878.11682225.

International Search Report issued in co-pending International Application No. PCT/US15/64239 dated Apr. 21, 2016.

* cited by examiner

UNDERGARMENT WITH SUPPORT STRUCTURE

CROSS REFERENCE TO RELATED APPLICATION

This application is based upon co-pending and co-owned U.S. Provisional Patent Application Ser. No. 62/088,969 entitled "Undergarment with Support Structure," filed with the U.S. Patent and Trademark Office on Dec. 8, 2014, the specification of which is incorporated herein by reference.

FIELD OF THE INVENTION

This invention relates to sport undergarments, and more particularly to an undergarment that may be worn to provide male anatomical support during various physical activities.

BACKGROUND OF THE INVENTION

Athletes will often wear sporting apparel that is specialized to the activities in which they are engaged. Particularly, as many sports carry risk of impact injury to an athlete's groin, it has long been advised that athletes wear an athletic cup to protect their genitals against injury during such activities. Unfortunately, prior constructions that have sought to incorporate systems for holding an athletic cup, and for otherwise supporting the wearer's genitalia, have lacked comfort and have not been widely accepted. For instance, a survey of student athletes conducted by the Society for Pediatric Urology indicated that across all sports, 87.5% of those surveyed reported not wearing athletic cups during practices or games, evidencing that despite the need to protect against injury, athletes are typically not inclined to take adequate protection.

An often-cited reason for not wearing a protective athletic cup is the discomfort that an athlete often feels when wearing such equipment. Particularly, movement and shifting of the athletic cup during athletic movements tends to shift the orientation of the cup with respect to the wearer's genitalia, making it uncomfortable at best, and creating a crushing point-impact injury at worst.

In light of the shortcomings of such prior configurations, there remains a need in the art for an undergarment that is comfortable to wear and that provides sufficient support to the male wearer's genitalia during athletic movements, and that particularly can maintain an athletic cup in its intended position throughout even aggressive athletic movements.

SUMMARY OF THE INVENTION

Disclosed is an undergarment having a support system configured to comfortably support a male wearer's genitalia while ensuring constant alignment of an athletic cup held in an exterior pocket of the undergarment, even through aggressive athletic movements. In certain configurations, an athletic cup pocket may be provided at the front of the undergarment having an open bottom that allows the bottom of the athletic cup to extend through such pocket. Inside of the undergarment, an internal pocket is formed by a generally H-shaped insert that holds the male wearer's genitalia in a forward position and keeps the wearer's genitalia aligned with the internal portion of the athletic cup positioned at the front of the undergarment. Additionally, the H-shaped insert positions the male wearer's genitalia away from their legs, providing increased support and comfort for the wearer. More particularly, the internal compartment creates a fabric barrier between the top, inside portion of each leg and the central groin, decreasing the risk of chaffing. A cross-wall defining the back of the internal pocket not only holds the wearer's genitalia to prevent it from dropping backward or downward, but also presses against the wearer's perineum at its top edge to further aid in creation of a barrier that even further reduces the risk of chaffing. The side panels of the H-shaped insert are so positioned with respect to the wearer's anatomy so as to pull the back portion of the undergarment forward against the wearer's buttocks, and the bottom portion of the undergarment upward against the bottom of the wearer's torso (and particularly against the wearer's perineum), when worn. Moreover, placement of an athletic cup in the front of the undergarment, in combination with the position of the H-shaped insert, further this effect of pulling the interior of the undergarment against the wearer's body while both preventing chaffing of the wearer's upper thighs and holding the wearer's genitalia in a forward position.

In accordance with certain aspects of an embodiment of the invention, an undergarment is provided having a compression shorts exterior; an H-shaped insert attached to an interior of the compression shorts, the H-shaped insert further comprising a first side panel having a bottom edge affixed to an interior of the shorts, and a top edge opposite the bottom edge of the first side panel;

a second side panel having a bottom edge affixed to the interior of the shorts, and a top edge opposite the bottom edge of the second side panel, the second side panel extending parallel to the first side panel; and a central panel attached to and extending perpendicular to each of the side panels; wherein a front edge of each of the side panels is attached to an interior front side of the compression shorts, and a second edge of each of the side panels opposite the front edges is attached to an interior of the compression shorts at a location such that, when worn, the second edge aligns with a location on a wearer's body that is rearwardly adjacent to the wearer's femur bone socket.

In accordance with further aspects of an embodiment of the invention, an undergarment is provided comprising a compression shorts exterior, the compression shorts exterior further comprising a central shorts panel having a head region having a front top edge and two head region side edges, each head region side edge convexly curving inwardly to a mid-region point, and a tail region having a rear top edge and two tail region side edges, each tail region side edge concavely curving inwardly from the rear top edge to the mid-region point; and two leg panels, each of the leg panels having a leg panel top edge, a leg panel bottom edge, a lower cylindrical portion extending upward from the leg panel bottom edge, and a curved upper seam extending upward from the lower cylindrical portion, the curved upper seam having an upper seam front portion affixed to one of the head region side edges of the shorts central panel, and an upper seam back portion affixed to one of the tail region side edges of the shorts central panel; a curved side panel attached to the intersection of each leg panel curved upper seam with the shorts central panel, each curved side panel extending along the front upper seam of the leg panel and only a portion of the back upper seam of the leg panel so as to terminate at a position adjacent a wearer's perineum when worn; and a central genitalia support panel extending between and affixed to each curved side panel and extending over the central shorts panel at the mid-region point.

BRIEF DESCRIPTION OF THE DRAWINGS

The numerous advantages of the present invention may be better understood by those skilled in the art by reference to the accompanying drawings in which.

DETAILED DESCRIPTION

The invention summarized above may be better understood by referring to the following description, claims, and accompanying drawings. This description of an embodiment, set out below to enable one to practice an implementation of the invention, is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Disclosed is an athletic undergarment configured to provide comfortable support to a male wearer during athletic activities. In certain configurations, such undergarment is configured to ensure that the wearer's genitalia are protected from impact during such activities. More particularly, the undergarment described herein includes an internal structure that creates a compartment to support male genitalia, and to optionally position the male genitalia with respect to an athletic cup held in an exterior pocket so as to at all times keep the wearer's genitalia within the perimeter of the athletic cup, even during aggressive athletic movements.

Figure 1:
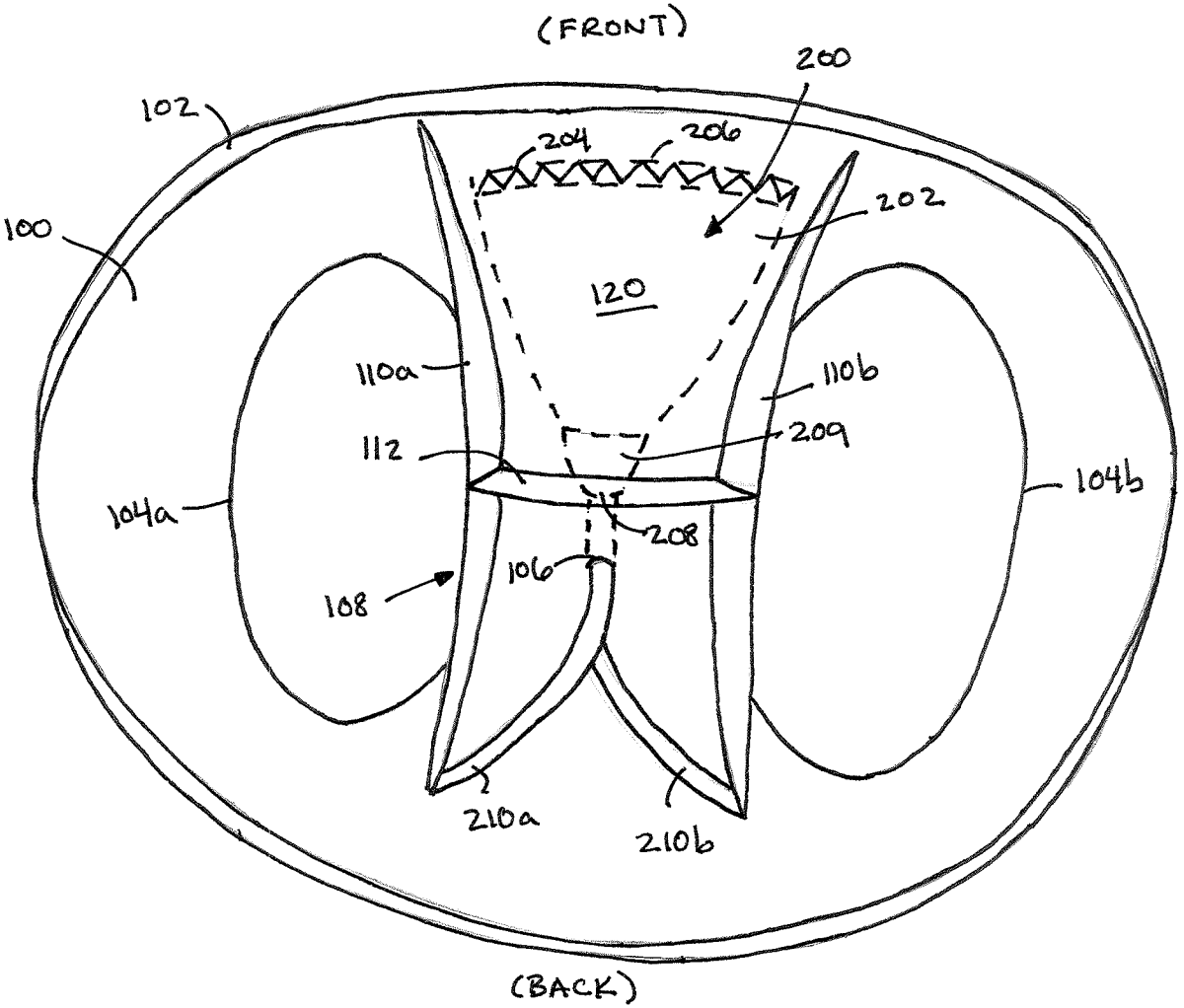
FIG. 1 is a top view of an undergarment in accordance with certain aspects of the invention.

As shown in the top-down view of FIG. 1, the undergarment comprises shorts that include, in general, outer compression shorts 100 having a waistband 102 and leg hole openings 104*a* and 104*b*. From the perspective of FIG. 1, the top of the Figure represents the front of shorts 100, and the bottom of the Figure represents the back of the shorts 100. Compression shorts 100 are of traditional configuration, such that when worn, the front, back, and sides of the shorts are in close contact with the wearer's torso. A generally H-shaped insert 108 is provided on the interior of the compression shorts 100 extending generally from front to back, and is preferably formed of spandex or cotton. The H-shaped insert includes a first side 110*a* adjacent first leg hole opening 104*a*, a second side 110*b* adjacent second leg hole opening 104*b*, and a central panel 112 extending between first side 110*a* and second side 110*b* and generally perpendicular to those two sides. Central panel 112 and the front portions of first side 110*a* and second side 110*b* form an internal pocket 120. When worn by a male, the front, upper portions of each of first side 110*a* and second side 110*b* of the H-shaped insert will sit immediately adjacent the wearer's legs and against their groin, so that internal pocket 120 will hold the wearer's genitalia in place in pocket 120, even through athletic movements (such as squatting).

Additionally, a jock strap assembly (shown generally at 200) may be provided, the jock strap assembly being configured to hold an athletic cup of traditional configuration. Jock strap 200 includes a front, external pocket 202 on an exterior, front side of compression shorts 100, which in certain configurations is sewn to the front of compression shorts 100 along a seam 204 at the top edge 206 of pocket 202. In this configuration, the sides of pocket 202 are not sewn to the front of compression shorts 100 so that an athletic cup may be inserted into pocket 202, and so as to have the cup-holding pocket 202 attached to the shorts only along seam 204. Jock strap 200 narrows from top edge 206 towards its back edge 208, and forms a generally triangularly-shaped pocket 209 at its base configured to receive the narrow, bottom end of a traditional athletic cup (not shown). A connecting member is provided, which may include straps 210*a* and 210*b* extending outward from the back edge 208 of jock strap 200, and passing through an opening 106 in the bottom, back center of compression shorts 100. Further, the free ends of each of straps 210*a* and 210*b* are sewn to the back ends of first side 110*a* and second side 110*b* of the H-shaped insert, respectively, where those first and second sides 110*a* and 110*b* are attached to the interior of compression shorts 100. Thus, while external pocket 202 configured as shown in FIG. 1 is not detachable from shorts 100, the bottom, rear portion of external pocket 202 may move relatively freely with respect to shorts 100, with seam 204 acting essentially as a hinge for external pocket 202, and allowing the bottom-most portion of external pocket 202 to vary position with respect to shorts 100 so as to accommodate wearers' differing body sizes.

Moreover, anchoring the top, front edge of the jock strap 200 to the front, exterior of compression shorts 100, and anchoring the rear portion of straps 210*a* and 210*b* of jock strap 200 to the back, interior of compression shorts 100, aids in pulling the bottom of the cup upwards so that it sits tighter against the wearer's body than it would in typical jock strap configurations. More particularly, the configuration of the instant invention creates and takes advantage of open space behind the wearer's genitals, with straps 210*a* and 210*b* extending through such open space, providing a more upwardly and rearwardly directed pull on back edge 208 of external pocket 202. Further, as straps 210*a* and 210*b* pull the back edge 208 of external pocket 202 inward towards the wearer's groin, the back edge 208 of external pocket 202 (and thus the bottom-most portion of an athletic cup positioned within external pocket 202) extends rearward of central panel 112 as it is pulled toward the wearer's groin. In this position, the athletic cup held in external pocket 202 overlaps internal pocket 120, such that the male wearer's genitalia is automatically positioned within the athletic cup. Further, the pulling force exerted on the back edge 208 of external pocket 202 by straps 210*a* and 210*b* when the shorts are worn ensures that the athletic cup is continuously pulled against the wearer's groin to ensure that the wearer's genitalia is both comfortably contained in internal pocket 120 and protected by the athletic cup positioned in external pocket 202, and remains within the perimeter of an athletic cup positioned in external pocket 202 even during athletic exercises and movements.

While not shown in the Figures, a single fabric member may be provided in the general form of a triangle, joining back edge 208 of external pocket 202 to the back, interior of compression shorts 100, instead of separate straps 210*a* and 210*b*, with the triangular fabric member being sewn across the back, interior of compression shorts 100. In this optional configuration, straps 210*a* and 210*b* become the outline of the triangular fabric member, with the seam for such member running from the location of one strap to the other strap.

Figure 2:
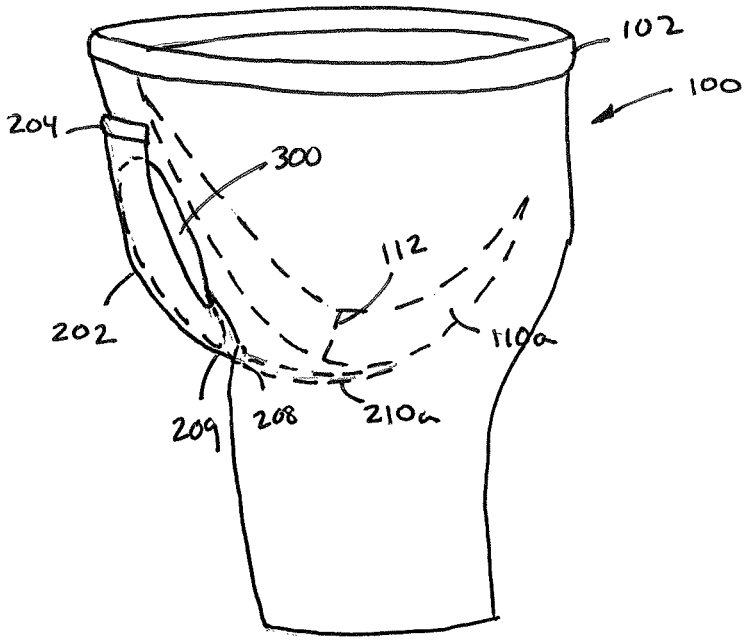
FIG. 2 is a side view of the undergarment of FIG. 1.
Figure 3:
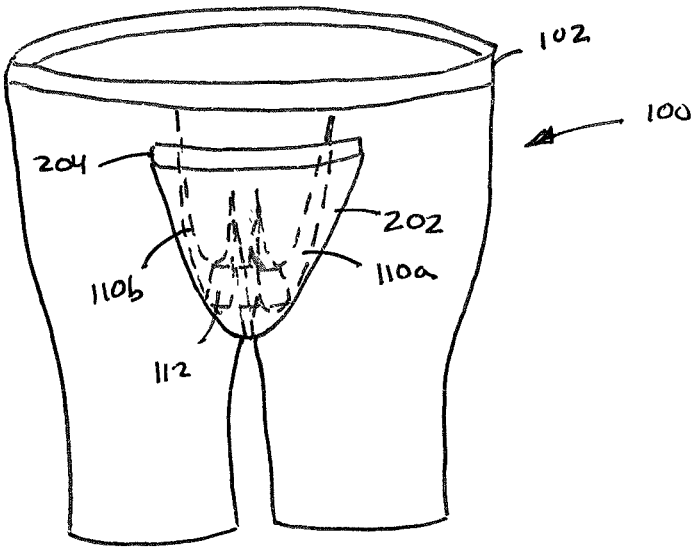
FIG. 3 is a front view of the undergarment of FIG. 1.

FIG. 2 is a side view of compression shorts 100, and FIG. 3 is a front view of compression shorts 100, each showing the above-described support system (the internal components of the system being shown in phantom). More particularly, external pocket 202 is shown attached at seam 204 to the front of shorts 100, with seam 204 positioned preferably about 1.5 inches below waistband 102. The sides of external pocket 202 remain open such that an athletic cup 300 (FIG. 2) may be inserted into external pocket 202 from either of its open sides. The bottom most portion of athletic cup 300 sits within triangularly shaped pocket 209 formed at the back end 208 of external pocket 202, and as back end 208 of external pocket 202 is not fixed to the exterior of shorts 100, a degree of movement is available between pocket 202 and the interior of shorts 100, and thus between the athletic cup 300 and the interior of shorts 100, to accommodate the differing shapes and sizes of various wearers. Nonetheless, such freedom of movement exists primarily only during placement of the shorts 100 on the wearer, as when the shorts 100 are worn, straps 210*a* and 210*b* pull the back end 208 of external pocket 202 inward toward the wearer's groin and will hold the external pocket 202, and any cup 300 held therein, in place in a fixed position against the wearer's groin.

FIGS. 2 and 3 also show sides 110*a* and 110*b* of H-shaped insert 108, along with central panel 112 extending between sides 110*a* and 110*b* and positioned so as to align with the wearer's perineum, such that the resulting internal pocket 120 will hold the wearer's genitalia in a forward position and in alignment with the interior of cup 300 while the shorts 100 are worn, including throughout athletic movements.

It is not necessary that pocket 202 be formed with open sides and a closed top, or that straps 210*a* and 210*b* attach such pocket 202 to compression shorts 100. Rather, in certain configurations, pocket 202 may be provided on the interior or exterior of compression shorts 100 with sewn sides and an open top to receive an athletic cup, and straps 210*a* and 210*b* eliminated from the undergarment. In this configuration, the specific placement of side panels 110*a* and 110*b*, and particularly the points at which side panels 110*a* and 100*b* attach to the interior of compression shorts 100, will pull the back section of the compression shorts 100 forward against the wearer's buttocks and the bottom section of the compression shorts 100 upward against the wearer's perineum, such that the top portions of side panels 110*a* and 110*b* sit flush against the bottom of the wearer's torso, and the top of central panel 112 sits flush against the bottom of the wearer's torso and behind their genitalia, thus protecting the wearer's upper thighs against chaffing and holding the wearer's genitalia in a forward position. Moreover, placing an athletic cup into pocket 202 in this configuration further tightens the compression shorts 100 against the wearer's body, even further improving the protection against chaffing and holding the wearer's genitalia in a forward position and fully in alignment with the interior portion of such athletic cup.

Figure 4:
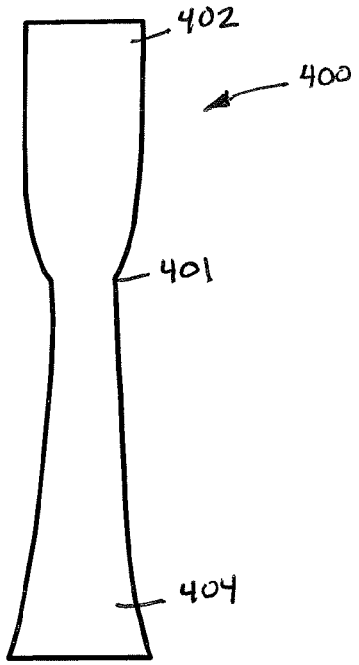
FIG. 4 is a schematic view of a pattern suitable for use in forming the undergarment of FIG. 1.
Figure 4:
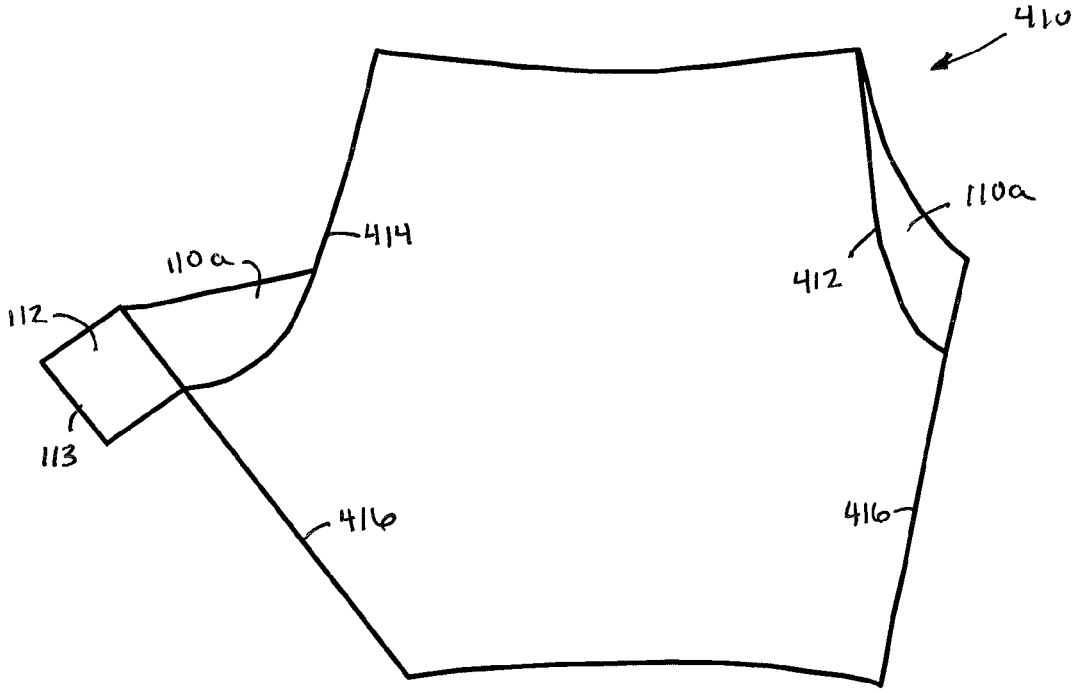

FIG. 4 is an exemplary pattern that may be used to form the shorts 100 as described above. As shown in FIG. 4, a shorts central panel 400 is provided and includes a wide head region 402 that narrows along curved side edges to a mid-region point 401 (the location at which central panel 112 crosses over shorts central panel 400), with each curved side edge joining to a front, upper seam 412 of each pant leg panel 410. Central panel 400 also includes a tail region 404 extending from the end of wide head region 402 to the back end of central panel 400, and having curved side edges that widen from the intersection with wide head region to the back end of central panel 400. Further, each curved side edge of tail region 404 joins to a back, upper seam 414 of each pant leg panel 410. Each pant leg panel 410 wraps into a generally cylindrical shape, such that the bottom leg seams 416 of each pant leg panel join to one another. Each pant leg panel 410 also includes a side 110*a* or 110*b* of H-shaped insert 108 (which may be separated into two segments when initially forming the pant leg panel 410, but ultimately joining together into a single side of H-shaped insert 108). Likewise, one of pant leg panels 410 includes central panel 112, which may be joined along its free edge 113 to the side 110*b* of the other pant leg panel 410 when the two pant leg panels 410 are joined to central panel 400.

As mentioned above, compression shorts 100 need not be formed with straps 110*a* and 110*b*, and may instead be provided with an athletic cup compartment sewn at both sides to either the interior or exterior of the front portion of compression shorts 100, forming pocket 120 with an open top for receiving an athletic cup. In such configuration, pocket 120 is preferably open at the bottom so that the bottom portion of an athletic cup may extend through the bottom of pocket 120 so that it is positioned, when worn, behind central panel 112.

Figure 5:
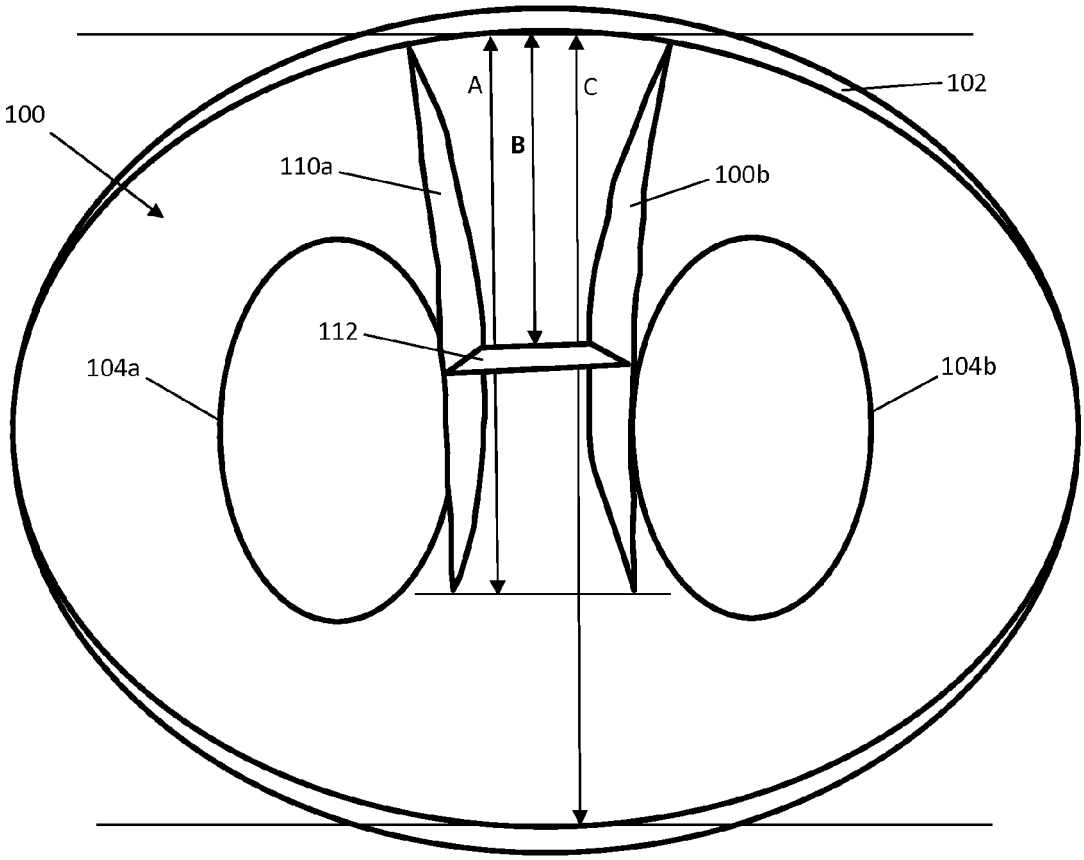
FIG. 5 is a top view of an undergarment in accordance with further aspects of the invention and showing representative dimensions for various elements of the undergarment.

In order to maximize the benefits of protecting against chaffing of the wearer's upper thighs and groin, and positioning the wearer's genitalia in a forward position throughout athletic movements, proper placement of side panels 110*a* and 110*b* and central panel 112 (and of their attachment to the interior of compression shorts 100) is an important aspect. FIG. 5 shows preferable dimensions that have been found to be optimal for such placement. As shown in FIG. 5, the total distance from the bottom of the waistband 102 at the front of the compression shorts 100 to the bottom of the waistband 102 at the back of the shorts (dimension "C") along upper seams 412 and 414 (where shorts central panel 400 attaches to each pant leg panel 410) is preferably 54 cm (representing the full length of the side edges of central panel 400 shown in FIG. 4), although such dimension may be modified to suit individuals of differing body sizes, with the points of attachment of H-shaped insert 108 proportionally altered to maintain the same alignment with the wearer's anatomy as discussed here. For compression shorts 100 having such a front to back length span of 54 cm, the rear portion of side panels 110*a* and 110*b* of H-shaped insert 108 are attached to the interior of compression shorts 100 a distance of 31-32 cm from the bottom of waistband 102 at the front of compression shorts 100 (dimension "A") measured along upper seams 412 and 414, with central panel 112 positioned a distance of 22-23 cm from the bottom of waistband 102 at the front of compression shorts 100 (dimension "B") measured along upper seams 412 and 414. In general, and so as to allow the foregoing dimensions to be proportionally varied for persons of differing body sizes, side panels 110*a* and 110*b* of H-shaped insert 108 extend preferably 65-68% of the distance from the bottom of waistband 102 at the front of compression shorts 100 (dimension "A") to the bottom of waistband 102 at the rear of compression shorts 100 along upper seams 412 and 414, with central panel 112 positioned preferably 40-43% of the distance from the bottom of waistband 102 at the front of compression shorts 100 (dimension "B") to the bottom of waistband 102 at the rear of compression shorts 100 along upper seams 412 and 414.

Such positioning of both the central panel 112 and side panels 110*a* and 110*b* of H-shaped insert 108 causes the back end of each of side panels 110*a* and 110*b* to be positioned just rearward of the wearer's femur bone socket in the pubic bone, with central panel 112 positioned just forward of the wearer's femur bone socket. More particularly, in such configuration, the back end of each of side panels 110*a* and 110*b* is positioned adjacent the portion of the wearer's pubis to which the adductor magnus muscle attaches, with central panel 112 being positioned forward of both the adductor magnus muscle and the femur bone socket, and aligned with the region of the wearer's pubis to which the wearer's gracilis muscle attaches. Moreover, each side panel 110*a* and 110*b* extends forward from such rear attachment point, so that the top edge of at least a portion of each side panel 110*a* and 110*b* maintains contact with the wearer's skin that covers the intersection of the wearer's gracilis muscle, adductor magnus muscle, and ischiocavernous muscle with the inferior ramus of the pubis. Likewise, the upper edge of central panel 112 is positioned to maintain contact with a region of bottom of the torso of the wearer's body that is both forward of the femur bone socket and that is in-line with the region in which the wearer's gracilis muscle attaches to the wearer's pubis. Such alignment between the upper edge of central panel 112 and this region of the wearer's body is maintained throughout even aggressive athletic movements, including for example during squatting and returning to a standing position.

It has been found that such positioning of side panels 110*a* and 110*b* and of central panel 112 results in forwardly positioning the male wearer's genitalia forward of and in contact with (and supported from behind by) central panel 112, with side panels 110*a* and 110*b* sitting between the wearer's upper thighs at the intersection with the wearer's groin so as to maximize comfort in both standing and squatting positions while protecting against chaffing in all positions between the standing and squatting positions. Moreover, such positioning of side panels 110*a* and 110*b* has been found to pull the interior material of compression shorts 100 against the rear and bottom of the wearer's torso to maintain a tight fit and proper positioning of the side panels 110*a* and 110*b* and central panel 112 throughout such movements. It has been found that if the back end of side panels 110*a* and 110*b* are positioned too far rearward, the anchor point will perform poorly in both pulling the compression shorts 100 and H-shaped insert 108 tightly against the wearer's skin. Likewise, it has been found that if the back end of side panels 110*a* and 110*b* are positioned too far forward, the anchor point will perform poorly in ensuring constant and continuous contact of side panels 110*a* and 110*b* throughout their full length with the skin of the wearer's crotch, thus leaving that skin prone to chaffing. Furthermore, positioning central panel 112 too far forward will prevent central panel 112 from contacting the perineum as intended, and positioning central panel 112 too far rearward will result in improper positioning and support of the wearer's genitalia in a sufficiently forward position so as to provide comfortable support while avoiding chaffing of the wearer's perineum.

Still further, when provided with cup pocket 120, placement of an athletic cup in such cup pocket 120 results in side panels 110*a* and 110*b* pulling the athletic cup snug against the wearer's body, with the bottom of the athletic cup extending rearward of central panel 112 to ensure that the male wearer's genitalia at all times is aligned with the interior of the athletic cup.

In still other configurations of compression shorts 100, the undergarment may be provided without any pocket 120. In this configuration, in the event that the wearer wishes to use the undergarment when engaging in sports activities, the compression shorts may be worn with a jock strap and still provide the benefits of protection against chaffing of the wearer's upper thighs and forward positioning of the wearer's genitalia as discussed in detail above.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

What is claimed is:

1. An undergarment comprising:

a compression shorts exterior;

an H-shaped insert attached to an interior of said compression shorts, said H-shaped insert further comprising:

a first side panel having a top edge and a bottom edge, wherein said bottom edge of said first side panel is affixed to an interior of said shorts;

a second side panel having a top edge and a bottom edge, wherein said bottom edge of said second side panel is affixed to said interior of said shorts, said second side panel extending parallel to said first side panel; and a central panel attached to and extending perpendicular to each of said first side panel and said second side panel;

wherein a front edge of each of said side panels is attached to an interior front side of said compression shorts, and a second edge of each of said side panels opposite said front edges is attached to an interior of said compression shorts at a location such that, when worn, said second edge aligns with a location on a wearer's body that is rearwardly adjacent to the wearer's femur bone socket.

2. The undergarment of claim 1, wherein said central panel is positioned such that, when worn, said central panel aligns with a location on a wearer's body that is forwardly adjacent to the wearer's femur bone socket.

3. The undergarment of claim 2, wherein said central panel is further positioned such that, when worn, said central panel aligns with a location on a wearer's body that is forward of the wearer's femur adductor magnus muscle.

4. The undergarment of claim 1, wherein said second edge of each of said first side panel and said second side panel is attached to the interior of said compression shorts at a location such that, when worn, each said second edge aligns with a location on a wearer's body that is adjacent a portion of the wearer's pubis to which the wearer's adductor magnus muscle attaches.

5. The undergarment of claim 1, wherein said top edge of each of said first side panel and said second side panel is positioned such that, when worn, said top edge of each of said first side panel and said second side panel maintains continuous contact with a portion of the wearer's skin that covers an intersection of the wearer's gracilis muscle, adductor magnus muscle, and ischiocavernous muscle with the inferior ramus of the wearer's pubis.

6. The undergarment of claim 1, wherein each of said first side panel and said second side panel extends toward a rear portion of said compression shorts a distance that is 65 to 68 percent of a total distance from a top edge of a front side of said compression shorts to a top edge of a back side of said compression shorts.

7. The undergarment of claim 1, wherein said central panel attaches to each of said first side panel and said second side panel at a distance from a top edge of a front side of said compression shorts that is 40 to 43 percent of a total distance from said top edge to a top edge of a back side of said compression shorts.

8. The undergarment of claim 1, further comprising an athletic cup pocket at a front side of said compression shorts, said athletic cup pocket having an opening configured to receive an athletic cup therethrough.

9. The undergarment of claim 8, said athletic cup pocket having an open bottom configured to position a bottom of an athletic cup positioned in said pocket rearward of said central panel.

10. The undergarment of claim 9, further comprising a strap extending from a bottom of said cup pocket to an interior of a back side of said compression shorts.

11. An undergarment comprising:

a compression shorts exterior, said compression shorts exterior further comprising:

a central shorts panel having a head region having a front top edge and two head region side edges, each head region side edge convexly curving inwardly to a mid-region point, and a tail region having a rear top edge and two tail region side edges, each tail region side edge concavely curving inwardly from said rear top edge to said mid-region point; and two leg panels, each of said leg panels having a leg panel top edge, a leg panel bottom edge, a lower cylindrical portion extending upward from said leg panel bottom edge, and a curved upper seam extending upward from said lower cylindrical portion, said curved upper seam having an upper seam front portion affixed to one of said head region side edges of said shorts central panel, and an upper seam back portion affixed to one of said tail region side edges of said shorts central panel;

a first curved side panel attached to the intersection of a first one of said leg panel curved upper seams with said shorts central panel and a second curved side panel attached to the intersection of a second one of said leg panel curved upper seams with said shorts central panel, each of said first and second curved side panels extending along a respective upper seam front portion of said leg panel and only a portion of a respective upper seam back portion of said leg panel so as to terminate at a position adjacent a wearer's perineum when worn; and a central genitalia support panel extending between each of said first curved side panel and said second curved side panel, and extending over said central shorts panel at said mid-region point.

12. The undergarment of claim 11, wherein said central genitalia support panel is positioned such that, when worn, said central genitalia support panel aligns with a location on a wearer's body that is forwardly adjacent to the wearer's femur bone socket.

13. The undergarment of claim 12, wherein said central genitalia support panel is further positioned such that, when worn, said central genitalia support panel aligns with a location on a wearer's body that is forward of the wearer's femur adductor magnus muscle.

14. The undergarment of claim 11, each of said first curved side panel and said second curved side panel having a front edge attached to an interior front side of said compression shorts and a second edge opposite said front edge attached to an interior of said compression shorts at a location such that, when worn, said second edge aligns with a location on a wearer's body that is adjacent a portion of the wearer's pubis to which the wearer's adductor magnus muscle attaches.

15. The undergarment of claim 11, wherein a top edge of each of said first curved side panel and said second curved side panel is positioned such that, when worn, said top edge of each of said first curved side panel and said second curved side panel maintains continuous contact with a portion of the wearer's skin that covers an intersection of the wearer's gracilis muscle, adductor magnus muscle, and ischiocavernous muscle with the inferior ramus of the wearer's pubis.

16. The undergarment of claim 11, wherein each of said first curved side panel and said second curved side panel extends toward a rear portion of said compression shorts a distance that is 65 to 68 percent of a total distance from a top edge of a front side of said compression shorts to a top edge of a back side of said compression shorts.

17. The undergarment of claim 11, wherein said central panel attaches to each of said first curved side panel and said second curved side panel at a distance from a top edge of a front side of said compression shorts that is 40 to 43 percent of a total distance from said top edge to a top edge of a back side of said compression shorts.

18. The undergarment of claim 11, further comprising an athletic cup pocket at a front side of said compression shorts, said athletic cup pocket having an opening configured to receive an athletic cup therethrough.

19. The undergarment of claim 18, said athletic cup pocket having an open bottom configured to position a bottom of an athletic cup positioned in said pocket rearward of said central panel.

20. The undergarment of claim 19, further comprising a strap extending from a bottom of said cup pocket to an interior of a back side of said compression shorts.

* * * * *